US009612037B2

(12) United States Patent
Farris

(10) Patent No.: US 9,612,037 B2
(45) Date of Patent: Apr. 4, 2017

(54) GAS WATER HEATER CONTROL ALTERNATE POWER SOURCE

(71) Applicant: General Electric Company, Schenectady, NY (US)

(72) Inventor: Brett Alan Farris, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 211 days.

(21) Appl. No.: 14/503,509

(22) Filed: Oct. 1, 2014

(65) Prior Publication Data

US 2016/0097563 A1 Apr. 7, 2016

(51) Int. Cl.
*F24H 9/20* (2006.01)

(52) U.S. Cl.
CPC ..... *F24H 9/2035* (2013.01)

(58) Field of Classification Search
CPC ..... F24H 9/2035; F24H 9/2042; F24H 9/205
USPC ..... 122/4 A, 14.1; 392/441
See application file for complete search history.

(56) References Cited

U.S. PATENT DOCUMENTS 4,696,639 A * 9/1987 Bohan, Jr. ..... F23N 5/102 137/66
7,317,265 B2 * 1/2008 Chian ..... H02J 7/34 136/205
7,585,397 B2 9/2009 Bollinger
2002/0132202 A1 * 9/2002 Clifford ..... F24H 9/2035 431/264
2007/0212036 A1 * 9/2007 Halsall ..... F24H 1/202 392/451
2012/0126620 A1 * 5/2012 Huang ..... H02J 9/06 307/64
2013/0294130 A1 * 11/2013 Oe ..... H01M 8/04955 363/141
2014/0262822 A1 * 9/2014 Knoeppel ..... C23F 13/04 205/726
2014/0376899 A1 * 12/2014 Boros ..... C23F 13/00 392/457
2015/0041000 A1 * 2/2015 Smart ..... G01M 3/02 137/551

FOREIGN PATENT DOCUMENTS

CN 202511469 U 10/2012

OTHER PUBLICATIONS

Janardan Prasad, M. N. Jayaswal, Vishnu Priye; Instrumentation and Process Control; 2010; IK INternational Publishing House Pvt. Ltd; 370.*

* cited by examiner

*Primary Examiner* — Steven B McAllister
*Assistant Examiner* — Steven Anderson, II
(74) *Attorney, Agent, or Firm* — Dority & Manning, P.A.

(57) ABSTRACT

Systems, circuits, and methods for providing operating power to a gas control circuit board are disclosed. A first power source for a gas control circuit board is derived from a utility supplied AC source while a backup supply is provided based on current flowing through an anode rod associated with the water heater as defined by Faraday's Law of Electrolysis. The backup supply based on anode current flow provided operating power for the gas control circuit in case of loss of power from the utility supplied AC source.

8 Claims, 1 Drawing Sheet

GAS WATER HEATER CONTROL ALTERNATE POWER SOURCE

FIELD OF THE INVENTION

The present subject matter relates to gas water heaters. More particularly, the present subject matter relates to systems and methods for providing operational power for control systems incorporated into gas water heaters.

BACKGROUND OF THE INVENTION

One of the major advantages associated with a gas water heater is that it can continue to operate during a power outage situation. Recent improvements in such gas water heater, however, including the implementation of electronic control of gas water heater and the implementation of gas/compressor hybrid water heater have offered many control and efficiency benefits. Unfortunately the use of electronic controls with gas and gas hybrid water heaters brings certain disadvantages especially during a power outage where loss of the operation of such controls along with the inability to provide hot water during such power outages. Thus, it would be advantageous to provide a small electronic control that can be used without the need for 120 VAC or 240 VAC power source.

Previous attempts to address this disadvantage involve the use of backup batteries and pilot light powered electronic controls. While such implementations do address the problem, they too have disadvantages. For example, batteries must be periodically replaced and pilot lights may be extinguished.

Thus, a need exists for systems and methods for ensuring the availability of operational power for gas and/or gas hybrid water heater control systems especially in the case of power line failure.

BRIEF DESCRIPTION OF THE INVENTION

Aspects and advantages of the invention will be set forth in part in the following description, or may be obvious from the description, or may be learned through practice of the invention.

One exemplary embodiment of the present disclosure is directed to a water heater system. In accordance with the present subject matter such water heater system includes a tank configured to contain water to be heated, an anode rod positioned within the tank, a gas heater and a gas control board, and first and second power supplies. The first power supply is configured to receive AC power from a utility line while the second power supply is configured to receive power from galvanic corrosion of the anode rod. In accordance with the present subject matter the first power supply provides operating power for the gas control board when AC power is available and the second power supply provides operating power for the gas control board when AC power is not available.

Another exemplary embodiment of the present disclosure is directed to a method of operating a gas water heater gas control board. According to such method a first source of operating power for the gas control board is provided from an AC power source while a second source of operating power for the gas control board is provided based on a current flowing through an anode rod associated with the water heater. In accordance with such method, the gas control board is operated from power from the second source when power from the first source is not available.

A further exemplary embodiment of the present disclosure is directed to a power supply system for a gas water heater gas control system. In accordance with the present subject matter such power supply system comprises a first power supply configured to receive AC power from a utility and to provide operating power the gas control circuit and a second power supply configured to provide operating power to the gas control circuit based on current flowing through an anode rod associated with the water heater.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
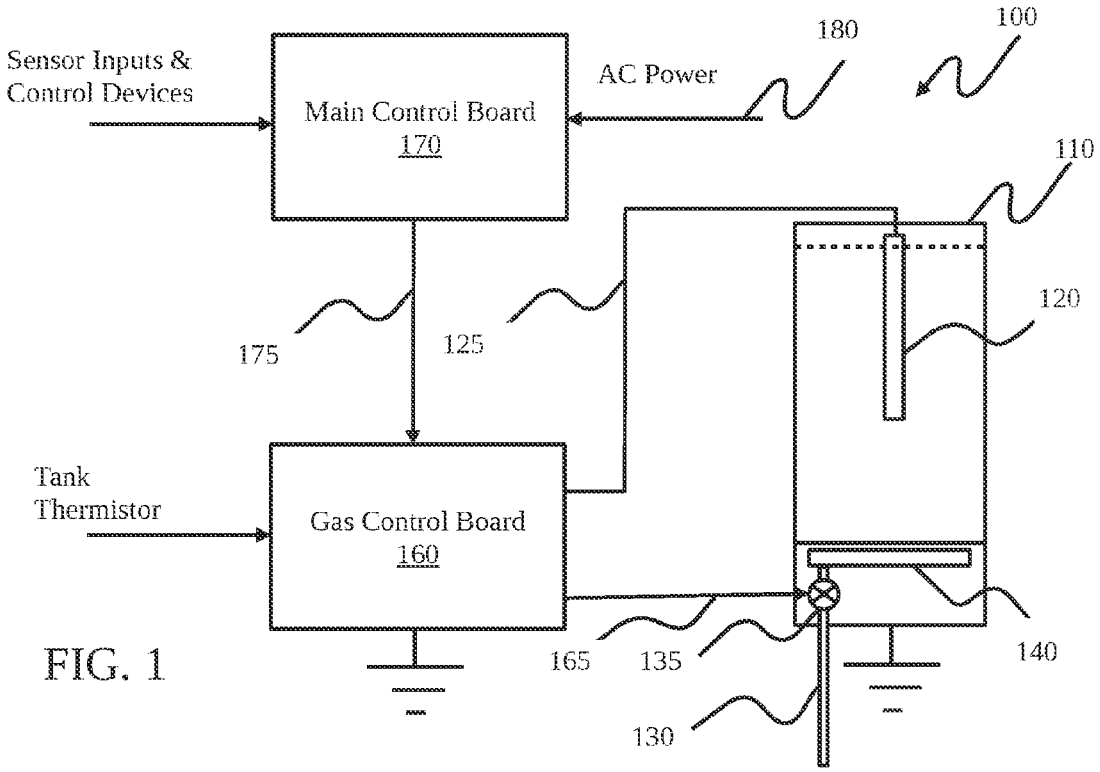
FIG. 1 provides an exemplary block diagram of a gas water heater control alternate power source configuration constructed in accordance with the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present subject matter is directed to a system and method for providing an alternative power source for gas control systems in gas and gas hybrid water heater systems.

As is well understood in the art, water heaters are generally provided with an anode rod whose sacrificial corrosion during water heater operation protects other components, for example, the water heater tank, from corrosion. In operation an anode rod in a water heater tank generates a DC current consistent with the amount of anode corrosion. This current is defined by Faraday's Law of Electrolysis and although such current varies with the amount of anode corrosion, the current may generally be on the order of several milliamperes. The present subject matter recognizes that this relatively small, naturally occurring current can could be used to power a small control board for periods of time and, in particular, during periods of loss of a normal electrical supply during unforeseen outages.

Referring more particularly to the presently disclosed subject matter and with reference to FIG. 1, an exemplary block diagram 100 of a gas water heater control alternate power source configuration constructed in accordance with the present subject matter is illustrated. As previously noted the present subject matter takes advantage of the recognition that a small current flowing in the anode/cathode corrosion circuit of the anode rod and water heater tank may be used in order to power a small electronic control board that is able to regulate a gas water heater valve.

With continued reference to FIG. 1, it will be seen that block diagram 100 illustrates a gas water heater 110 that incorporates an anode rod 120. The anode rod circuit is described further below, but for now it is noted that operating power for the electronics associated with gas control board 160 may be supplied, at least during power outage situations, from current flow through line 125 resulting from a galvanic corrosion process involving anode 120 and other water heater components, most notably, the water heater tank.

Gas is supplied to a burner 140 within water heater 110 by way of inlet line 130. In turn gas flow from inlet line 130 to burner 140 is controlled by valve 135, which itself is control by a signal over line 165 from gas control board 160. It should be appreciated that control signals over line 165 may also be used to control other components (not separately illustrated) associated with water heater 110. For example, signals may be sent over line 165 to a control circuit for a controllable pilot or to pass signals back to the gas control board from certain sensors, such as a safety sensor that might indicate a failure to ignite the pilot or burner.

Gas control board 160 receives signals from a tank thermistor (not separately illustrated) but, as is well understood in the art, supplies signals to gas control board 160 based on the water temperature within water heater 110. Gas control board 160 also receives signals as well as operating power along line 175 from main control board 170. Signals sent from main control board 170 to gas control board 160 may include water temperature setpoint information as well as other signals. For example and without limitation, main control board 170 may forward signals relating to remote control operations, for example, signals based on software decisions as from a home automation system, and signals from the utility company based on emergency or other conditions. As noted, operating power may also be supplied to gas control board 160 along line 175 based on power received during normal operations from AC power line 180 by main control board 170.

In the proposed configuration there is a main control board that handles control of the user interface, sealed system, and enabling of the gas system. This main control board is in communication with the small gas electronic control board. The main control board also provides power to this board during power ON times. The main control board always communicates the user setpoint to the small control board. Likely, the small control board is mounted close the pilot and main gas valves as to minimize harnessing and mechanical parts.

Figure 2:
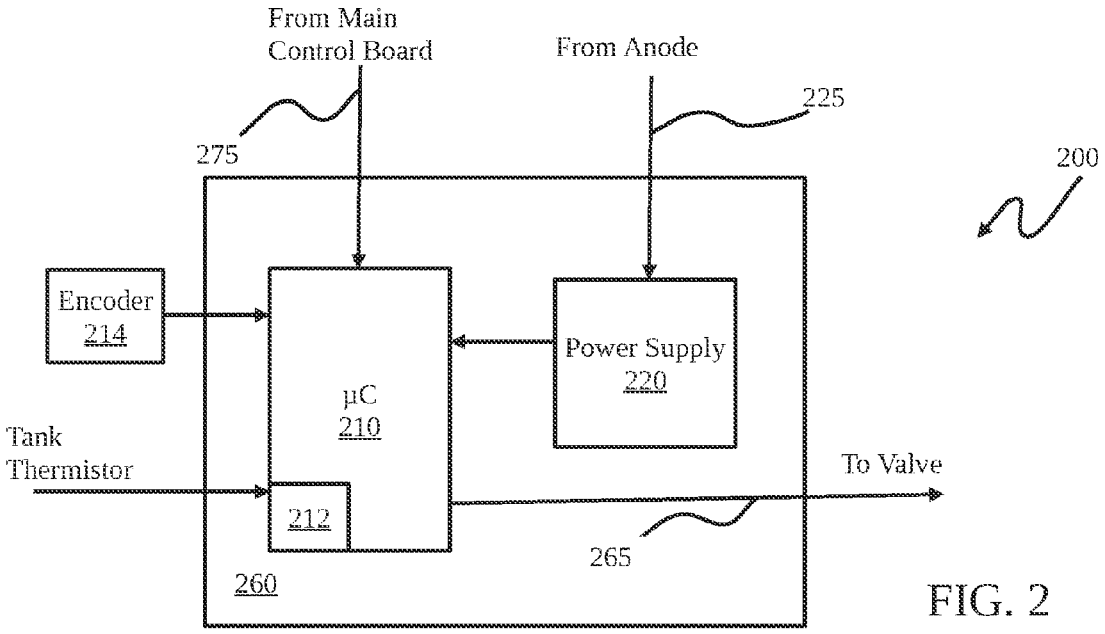
FIG. 2 provides a block diagram of a gas control circuit board incorporating an alternate power source in accordance with the present subject matter.

With reference to FIG. 2 there is illustrated a block diagram 200 of a gas control circuit board 260 incorporating an alternate power source in accordance with the present subject matter. In instance when main AC power 180 is lost, gas control circuit board 260 will contain sufficient information based, at least in part, on signals sent from mail control board via line 275 and from the tank thermister both as previously described with respect to FIG. 1 to accurately control the gas system portion of water heater 110 (FIG. 1). Gas control board 260 is configured to store in a memory portion 212 of microcontroller 210 or alternately within a separate memory, software that is suited for complete control of the gas system during both AC power ON and power OFF times.

In addition, operating power for microcontroller 210 may be supplied, at least during power OFF instances, from power supply 220 which is supplied with power based on current flow through line 225 from anode 120 (FIG. 1) resulting from galvanic current flow based on corrosion process involving anode 120 (FIG. 1) as previously described. In an exemplary configuration, power supply 220 may incorporate a boost type DC power supply. The provision of power supply 220 allows the relatively smaller gas control board 260 to operate independently or in conjunction with main control board 170 (FIG. 1). In this manner, a setpoint for gas control board 260 may be issued from main control board 170 or from an encoder type dial device 214. Such a configuration not only permits setpoint adjustment in instance of power outage but also provides setpoint features of a full electronic control when AC power is present.

It should be appreciated that while the present description has been directed primarily to gas water heater systems, aspects of the present subject matter may also be applied to hybrid gas water heaters. Incorporation of the subject matter in hybrid water heater systems would provide an improved dual fuel hybrid water heater configuration in that one would obtain efficiency using a compressor when possible and gas heat when needed. In this manner hot water would always available when power is out using the gas source.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater system, comprising:

a tank configured to contain water to be heated;

an anode rod positioned within said tank;

a gas heater configured to heat water contained in the tank;

one or more temperature sensing devices configured to sense a temperature of water contained in the tank;

a gas control valve configured to control gas flow to said gas heater;

one or more control devices configured to provide one or more setpoint instructions;

a gas control board configured to control said gas control valve based at least in part on one or more signals from the one or more temperature sensing devices and one or more setpoint instructions from the one or more control devices;

a first power supply configured to receive AC power from a utility line; and a second power supply configured to receive power from galvanic corrosion of said anode rod, wherein said first power supply provides power for said gas control board when AC power is available and said second power supply provides power for said gas control board when AC power is not available; and wherein said gas control board is configured to control said gas control valve independently of whether power for said gas control board is supplied from said first power supply or said second power supply.

2. A system as in claim 1, wherein said second power supply comprises a boost type DC power supply.

3. A system as in claim 1 wherein said gas control board comprises a microcontroller, wherein said microcontroller is configured to control said gas control valve independently of whether power for said gas control board is supplied from said first power supply or said second power supply.

4. A system as in claim 3, further comprising:

a main control board, wherein said main control board is configured to receive AC power from an AC power source and to provide power to said gas control board.

5. A system as in claim 4, wherein said main control board is configured to receive signals from the one or more temperature sensing devices and instructions from the one or more control devices and to forward control instructions to said gas control board.

6. A system as in claim 5, wherein said microcontroller is configured to store instructions from said main control board and to implement stored instructions upon loss of power from said first power supply while operating on power supplied from said second power supply.

7. A system as in claim 6, wherein the one or more temperature sensing devices comprise a thermistor associated with said tank, wherein said microcontroller is configured to receive signals from said thermistor and to control said gas control valve based at least in part on the received signals and stored instructions from said main control board.

8. A system as in claim 7, wherein the one or more control devices comprise a setpoint encoder device, wherein said setpoint encoder device is configured to provide setpoint instructions to said microcontroller upon loss of power from said first power supply.

* * * * *